US010279876B1

(12) United States Patent
Araki et al.

(10) Patent No.: US 10,279,876 B1
(45) Date of Patent: May 7, 2019

(54) PERSONAL WATERCRAFT

(71) Applicant: KAWASAKI JUKOGYO KABUSHIKI KAISHA, Kobe-shi, Hyogo (JP)

(72) Inventors: Toshio Araki, Kakogawa (JP); Toru Sato, Akashi (JP); Azusa Onohata, Kakogawa (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 16/110,515

(22) Filed: Aug. 23, 2018

(51) Int. Cl.
*B63B 35/74* (2006.01)
*B63B 35/81* (2006.01)

(52) U.S. Cl.
CPC ..... *B63B 35/81* (2013.01)

(58) Field of Classification Search
CPC ..... B63B 35/81; B63B 35/74
USPC ..... 114/363, 55.53, 55.57
See application file for complete search history.

(56) References Cited

U.S. PATENT DOCUMENTS 4,854,261 A * 8/1989 Goldsmith ..... B63B 29/04 114/363
5,255,626 A * 10/1993 Hattori ..... B63B 35/731 114/290
5,676,086 A * 10/1997 Watkins ..... B63B 35/731 114/343
6,530,336 B2 3/2003 Ibata et al.
2006/0102064 A1* 5/2006 Adamczyk ..... B63B 35/731 114/363
2010/0006019 A1* 1/2010 Knoblett ..... B63B 29/04 114/363
2010/0319604 A1* 12/2010 Mayrand ..... B63B 29/02 114/363

* cited by examiner

*Primary Examiner* — Stephen P Avila
(74) *Attorney, Agent, or Firm* — Alleman Hall Creasman & Tuttle LLP

(57) ABSTRACT

A personal watercraft comprises a body including a seat support section in which a storage is accommodated; a front seat which is mountable on the seat support section; a rear seat which covers the storage in a state in which the rear seat is secured onto the seat support section; an opening/closing mechanism including a pivot section provided at a front end portion of the rear seat and opens and closes the rear seat and a slider section which guides the pivot section and slides the rear seat in a rearward direction. In a closed state in which the front seat and the rear seat are secured onto the seat support section, a rear end of the front seat is located rearward of and above a front end of the rear seat, and the pivot section is located below and forward of the rear end of the front seat.

6 Claims, 6 Drawing Sheets

PERSONAL WATERCRAFT

BACKGROUND OF THE INVENTION

Field of the Invention

The present invention relates to a personal watercraft including a front seat and a rear seat.

Description of Related Art

A personal watercraft (PWC) is provided with a storage for storing belongings of a user. U.S. Pat. No. 6,530,336 discloses a storage disposed under a rear seat. In this PWC, by unlocking the rear seat and detaching the rear seat from a body, the user can access the storage.

However, in this structure, a place in which the rear seat detached from the body is placed is necessary, and work for detaching and attaching the rear seat is burdensome. In a case where the rear seat is provided with a hinge opening/closing mechanism and a front seat is located on a rotation trajectory of the rear seat, the rear seat cannot be rotated. For this reason, it becomes necessary to detach the front seat to access the storage disposed under the rear seat.

SUMMARY OF THE INVENTION

The present invention addresses the above-described conditions, and an object of the present invention is to provide a personal watercraft which allows a user to easily access a storage disposed under a rear seat without a need to detach a front seat.

According to an aspect of the present invention, a personal watercraft comprises: a body including a seat support section in which a storage is accommodated; a front seat which is mountable on a front portion of the seat support section and on which a rider is seated in a state in which the rider straddles the front seat; a rear seat which covers the storage from above in a state in which the rear seat is secured onto a rear portion of the seat support section, and on which a passenger is seated on the rear seat in a state in which the passenger straddles the rear seat; and an opening/closing mechanism including a pivot section which is provided at a front end portion of the rear seat and opens and closes the rear seat around a rotational axis line extending in a rightward and leftward direction, and a slider section which guides the pivot section and slides the rear seat in a rearward direction, the rear seat being configured to be opened to expose the storage, wherein in a closed state in which the front seat and the rear seat are secured onto the seat support section, a rear end of the front seat is located rearward of and above a front end of the rear seat, and the pivot section is located below and forward of the rear end of the front seat.

In accordance with this configuration, in a case where the rear end of the front seat is located rearward of and above the front end of the rear seat and the front seat is present on the rotation trajectory of the rear seat, the front seat can be located apart from the rotation trajectory of the rear seat without detaching the front seat, by guiding in the rearward direction the pivot section at the front end portion of the rear seat around which the rear seat is rotated, by the slider section, and by sliding the rear seat in the rearward direction. This allows a user to easily access the storage disposed at the underside of the rear seat without detaching the front seat.

The above and further objects, features and advantages of the present invention will more fully be apparent from the following detailed description of a preferred embodiment with reference to the accompanying drawings.

DETAILED DESCRIPTION OF THE PREFERRED EMBODIMENTS

Hereinafter, the embodiment of the present invention will be described with reference to the drawings. The stated directions are from the perspective of a rider riding in a personal watercraft.

Figure 1:
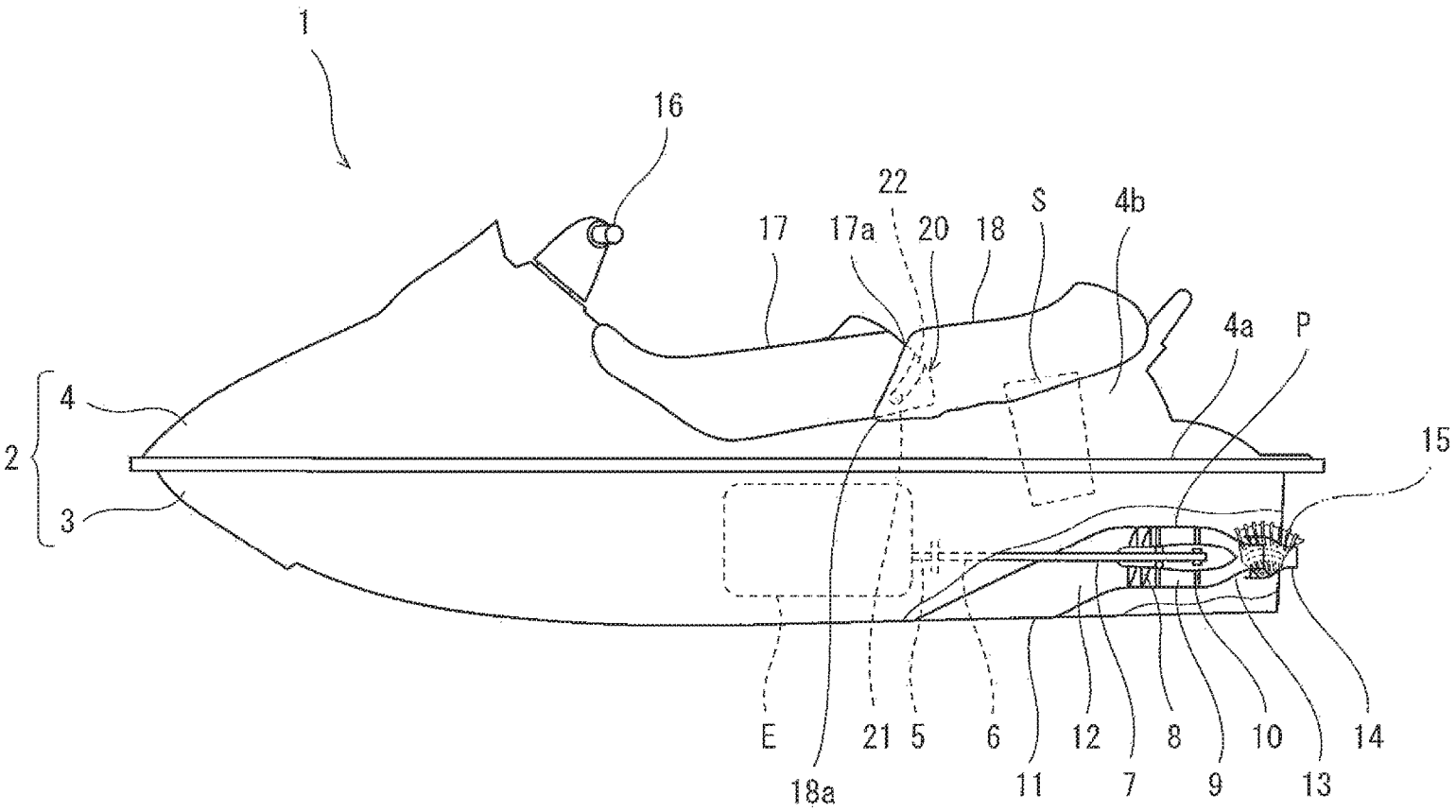
FIG. 1 is a side view of a personal watercraft according to an embodiment, a part of which is cut away (broken away).

FIG. 1 is a side view showing a personal watercraft 1 according to an embodiment, a part which is cut away (broken away). Referring now to FIG. 1, the personal watercraft 1 includes a body 2 including a hull 3 and a deck 4 covering the hull 3 from above. An engine E which is a prime mover (driving power source) which generates driving power for moving the body 2 is accommodated in an inner space of the body 2. An output shaft (crankshaft) 5 of the engine E extends rearward in the body 2. The rear end portion of the output shaft 5 is coupled to a propeller shaft 6. A water jet pump P is disposed at the rear portion of the hull 3. The rear end portion of the propeller shaft 6 is connected to a pump shaft 7 of the water jet pump P. The pump shaft 7 rotates in response to the rotation of the output shaft 5. An impeller 8 is mounted on the pump shaft 7. A fairing vane 9 is disposed rearward of the impeller 8. A pump casing 10 with a tubular shape is provided at the outer periphery of the impeller 8 to cover the impeller 8.

A water intake 11 opens in the bottom portion of the body 2. The water intake 11 and the pump casing 10 are in communication with each other via a water passage 12. A pump nozzle 13 is provided in the rear portion of the body 2 and connected to the pump casing 10. The pump nozzle 13 has a diameter reduced in a rearward direction. An ejection port opens at the rear end of the pump nozzle 13. A steering nozzle 14 is connected to the ejection port of the pump nozzle 13 in a state in which the steering nozzle 14 is pivotable to the right or the left. In the vicinity of the steering nozzle 14, a reverse bucket 15 with a bowl shape is disposed.

In the personal watercraft 1, the water is sucked through the water intake 11 provided at the bottom portion of the hull 3. Then, the water is pressurized and accelerated by a rotational force generated by the impeller 8 of the water jet pump P driven by the engine E. The resulting water flow is faired by the fairing vane 9, and a water jet is ejected in a rearward direction from the ejection port of the pump nozzle 13 through the steering nozzle 14. As a reaction of the water jet ejected from the water jet pump P through the steering nozzle 14, a propulsive force for moving the body 2 of the personal watercraft 1 is obtained. At the front side of a deck floor 4*a*, a steering handle bar 16 which can be gripped and operated by the rider is provided. When the rider tilts (rotates) the steering handle bar 16 to the right or the left, the steering nozzle 14 is pivoted to the right or the left in response to the rider's tilting operation of the steering handle bar 16.

The deck 4 includes a seat support section 4*b* protruding upward from the deck floor 4*a*, at a location that is rearward of the steering handle bar 16. A front seat 17 is mounted on the front portion of the seat support section 4*b*. The rider is seated on the front seat 17 in a state in which the rider straddles the front seat 17. A rear seat 18 is mounted on the rear portion of the seat support section 4*b* at a location that is rearward of and adjacent to the front seat 17. A passenger is seated on the rear seat 18 in a state in which the passenger straddles the rear seat 18. An inner space of the seat support section 4*b* is opened in an upward direction. An upper opening of the seat support section 4*b* is covered and closed by the front seat 17 and the rear seat 18 from above. A storage S for storing belongings of a user or the like is provided in the rear portion of the inner space of the seat support section 4*b*. In brief, the rear seat 18 covers the storage S from above in a state in which the rear seat 18 is secured onto the rear portion of the seat support section 4*b*.

The personal watercraft 1 is provided with an opening/closing mechanism 20 which opens and closes the rear seat 18 between a closed state (closed position) and an open state (open position). In the closed state, the rear seat 18 closes the upper opening of the seat support section 4*b* and covers the storage S from above. In the open state, the rear seat 18 opens the upper opening of the seat support section 4*b* and exposes the storage S. The opening/closing mechanism 20 is manually opened and closed by the user. The opening/closing mechanism 20 includes a pivot section 21 and a slider section 22. The pivot section 21 is provided at the front end portion of the rear seat 18. The pivot section 21 causes the rear seat 18 to be opened and closed around a rotational axis extending in a rightward and leftward direction. The slider section 22 guides the pivot section 21 to slide the rear seat 18 in a rearward direction.

In the closed state in which the rear seat 18 is secured onto the seat support section 4*b*, the front edge of the rear seat 18 extends obliquely in the upward direction and in the rearward direction. In the closed state in which the front seat 17 is secured onto the seat support section 4*b*, a portion of the rear edge of the front seat 17, the portion being adjacent to the front edge of the rear seat 18, also extends obliquely in the upward direction and in the rearward direction. In the closed state in which the front seat 17 and the rear seat 18 are secured onto the seat support section 4*b*, a rear end 17*a* of the front seat 17 is located rearward of and above a front end 18*a* of the rear seat 18. In the closed state in which the front seat 17 and the rear seat 18 are secured onto the seat support section 4*b*, the pivot section 21 is located below and forward of the rear end 17*a* of the front seat 17.

Figure 2:
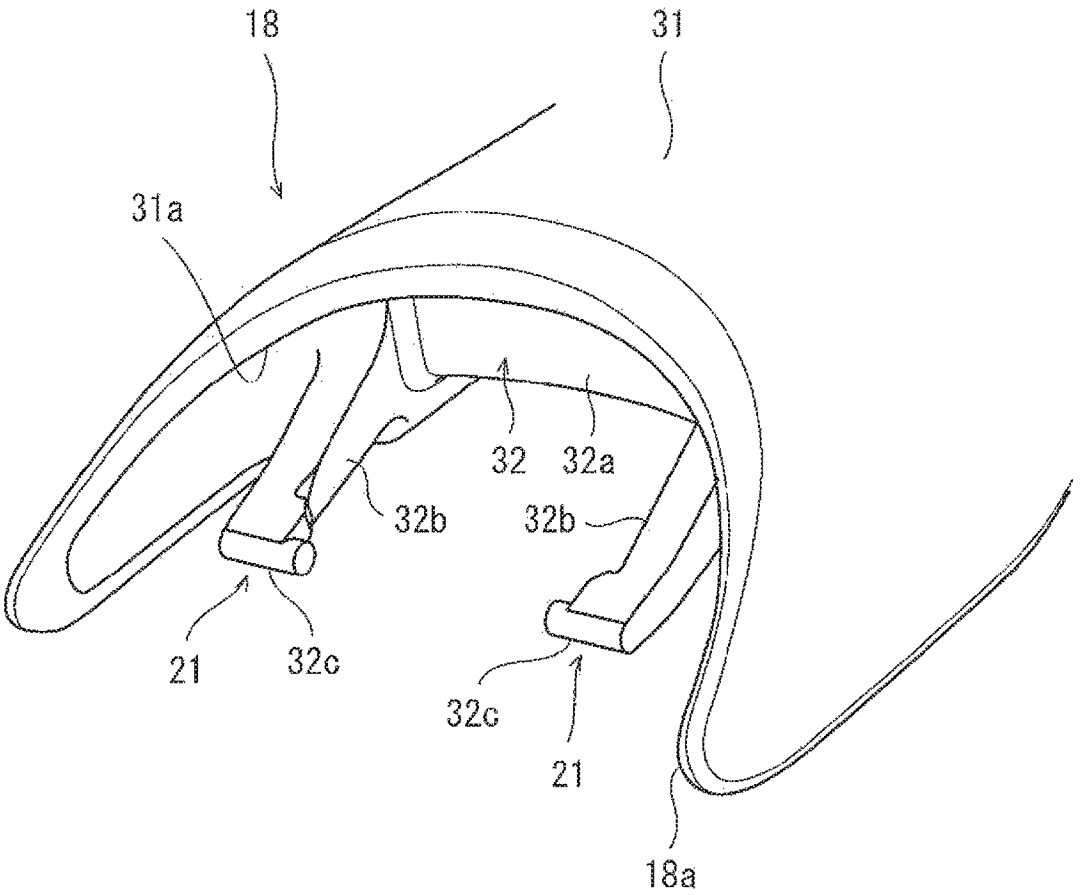
FIG. 2 is a perspective view showing the front portion of a rear seat of the personal watercraft of FIG. 1, when viewed from the left and the front.

FIG. 2 is a perspective view showing the front portion of the rear seat 18 of the personal watercraft 1 of FIG. 1, when viewed from the left and the front. As shown in FIG. 2, the rear seat 18 includes a rear cushion member 31, and a rear bottom plate 32 provided at the underside of the rear cushion member 31. The rear bottom plate 32 is integrally molded by use of a resin. The rear bottom plate 32 includes a bottom plate body (rear bottom plate body) 32*a*, a pair of right and left arms 32*b*, and a pair of right and left pins 32*c*.

The bottom plate body 32*a* is secured to the lower surface of the rear cushion member 31. The pair of right and left arms 32*b* are spaced apart from each other in the rightward and leftward direction. The pair of right and left arms 32*b* protrude obliquely in a forward direction and in a downward direction, from the bottom plate body 32*a*. The pair of right and left pins 32*c* protrude from the pair of right and left arms 32*b*, respectively such that the pins 32*c* are closer to each other. In a side view (when viewed from the side), the arms 32*b* and the pins 32*c* overlap with the front portion of the rear cushion member 31, within the contour of the rear cushion member 31 (the arms 32*b* and the pins 32*c* are accommodated within the contour of the rear cushion member 31). In other words, in the side view, the arms 32*b* and the pins 32*c* do not protrude outward from the contour of the rear cushion member 31. In a plan view (when viewed from above), a front edge 31*a* of the rear cushion member 31 has a depressed (recessed) shape which is depressed in the rearward direction.

Figure 3:
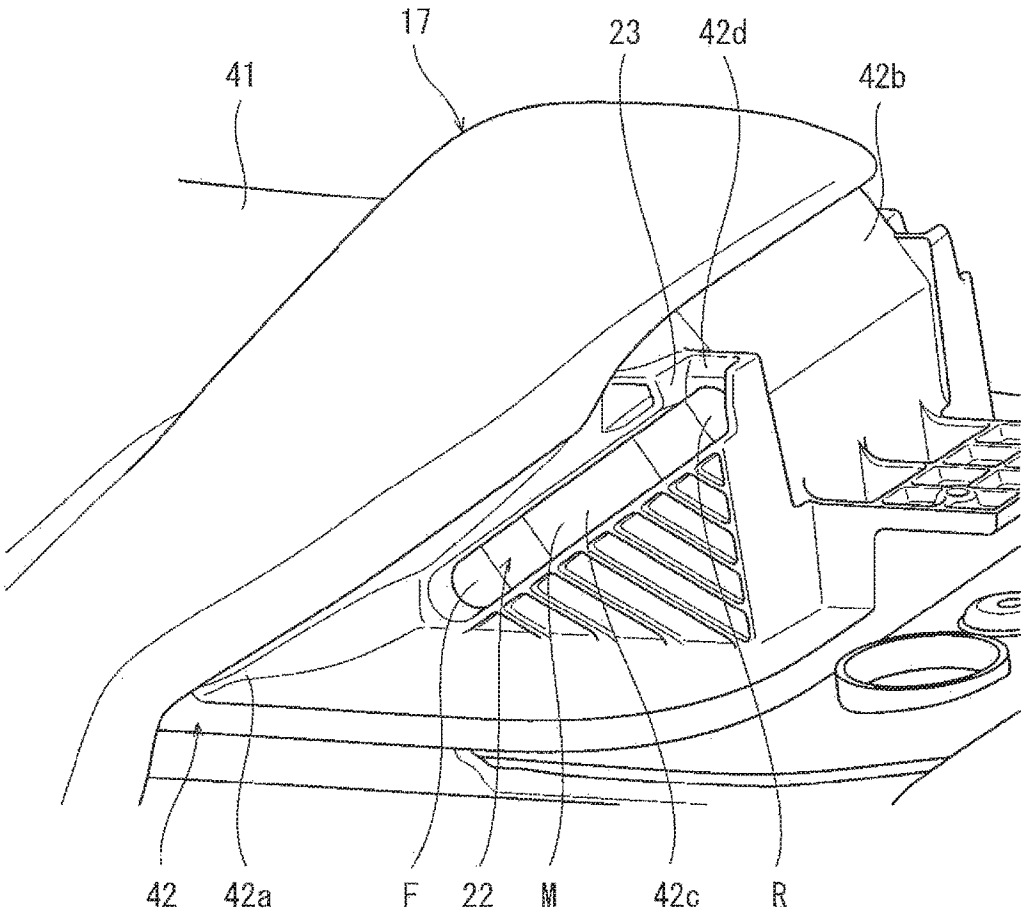
FIG. 3 is a perspective view of the rear portion of a front seat of the personal watercraft of FIG. 1, when viewed from the left and the rear.

FIG. 3 is a perspective view showing the rear portion of the front seat 17 of the personal watercraft 1 of FIG. 1, when viewed from the left and the rear. As shown in FIG. 3, the front seat 17 includes a front cushion member 41, and a front bottom plate 42 provided at the underside of the front cushion member 41. The front bottom plate 42 is integrally molded by use of a resin. The front bottom plate 42 includes a bottom plate body (front bottom plate body) 42*a*, a guide block 42*b*, and a pair of right and left guide grooves 42*c*.

The bottom plate body 42*a* is secured to the lower surface of the front cushion member 41. The guide block 42*b* protrudes rearward from the bottom plate body 42*a* and is supported by the seat support section 4*b*. The guide block 42*b* protrudes more rearward than the rear edge of the front cushion member 41. In the side view, the guide block 42*b* overlaps with the front portion of the rear seat 18. The pair of right and left guide grooves 42*c* are formed in right and left side surfaces, respectively, of the guide block 42*b*. In other words, the pair of right and left guide grooves 42*c* are depressed (recessed) to be closer to each other in the rearward direction. The right and left guide grooves 42*c* are located closer to a center in the rightward and leftward direction than the right and left ends of the front cushion member 41. The guide grooves 42*c* extend obliquely in the upward direction and in the rearward direction. In other words, the guide grooves 42*c* are inclined in the upward direction as they extend from the front to the rear.

The pair of right and left pins 32*c* (see FIG. 4) are fittable to the pair of right and left guide grooves 42*c*, respectively. Each of the guide grooves 42*c* includes a front region F in which the pin 32*c* is located in a state in which the rear seat 18 is at the closed position, a rear region R in which the pin 32*c* is located in a state in which the rear seat 18 is at the open position, and a middle region M provided between the front region F and the rear region R. The pivot section 21 is formed by the pair of right and left pins 32*c*. The slider section 22 is formed by the pair of right and left guide grooves 42*c*. Thus, the opening/closing mechanism 20 is provided only at the front bottom plate 42 and the rear bottom plate 32. With the above-described configuration, the pivot section 21 and the slider section 22 can be configured compactly. In addition, it is not necessary to provide a particular opening/closing mechanism at the body 2. As a result, the structure of the personal watercraft 1 can be simplified.

The opening/closing mechanism 20 further includes positioning sections 23 which support the rear seat 18 so that the rear seat 18 is inclined in the forward direction, in the open state in which the rear seat 18 exposes the storage S. The positioning sections 23 are provided at the guide block 42*b*. Specifically, each of the positioning sections 23 is a surface facing the corresponding arm 32*b* from the front, in a state in which the corresponding pin 32*c* is located in the rear region R of the guide groove 42*c*. More specifically, each of the positioning sections 23 is a surface which extends obliquely in the upward direction and in the forward direction, in the side view. Each of the positioning sections 23 contacts the corresponding arm 32*b* from the front and supports the arm 32*b* such that that the arm 32*b* is inclined in the forward direction, in a state in which the corresponding pin 32*c* is located in the rear region R of the guide groove 42*c*.

Each of the right and left guide grooves 42*c* of the guide block 42*b* is provided with an opening 42*d* which opens in the upward direction from the rear region R. The user can attach and detach the rear seat 18 to and from the front seat 17, by causing the pins 32*c* of the rear seat 18 to pass through through the openings 42*d*. In a case where the front seat 17 is detached from the body 2, the user detaches the rear seat 18 from the front seat 17 by causing the pins 32*c* to pass through the openings 42*d* from the lower to the upper, and then detaches the front seat 17 from the seat support section 4*b*.

Figure 4:
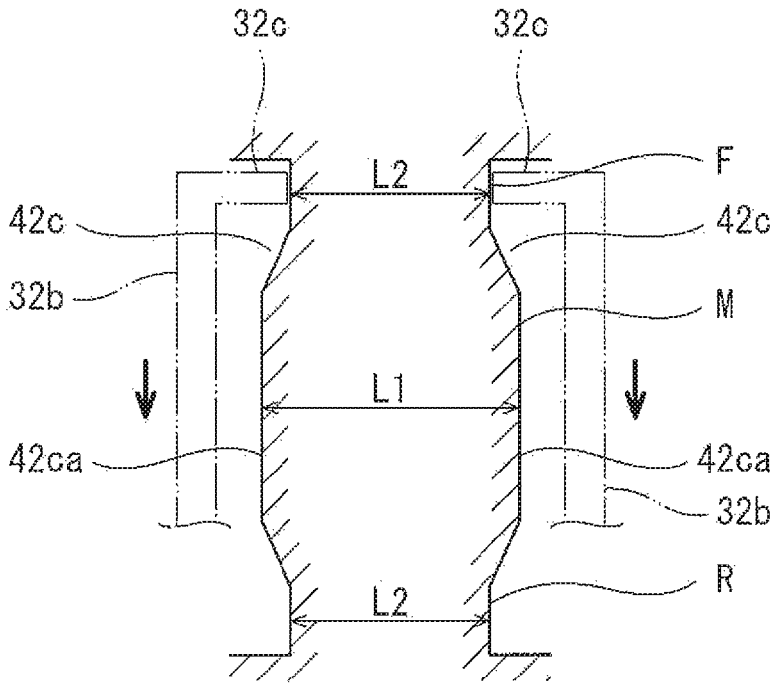
FIG. 4 is a schematic view showing distances in a rightward and leftward direction between bottom surfaces of a pair of right and left guide grooves formed in a front bottom plate of FIG. 3.

FIG. 4 is a schematic view showing distances L1, L2 in the rightward and leftward direction between bottom surfaces 42*ca* of the pair of guide grooves 42*c* formed in the front bottom plate 42 of FIG. 3. As shown in FIG. 4, the distance L1 in the rightward and leftward direction between the bottom surfaces 42*ca* of the middle regions M of the pair of right and left guide grooves 42*c* is longer than the distance L2 in the rightward and leftward direction between the bottom surfaces 42*ca* of the front regions F of the pair of right and left guide grooves 42*c*. In this structure, in a state in which the rear seat 18 is at the closed position, the pins 32*c* are easily positioned in the front regions F of the guide grooves 42*c*, respectively. The distance L1 is longer than the distance L2 in the rightward and leftward direction between the bottom surfaces 42*ca* of the rear regions R of the pair of right and left guide grooves 42*c*. A distance in the rightward and leftward direction between the bottom surfaces 42*ca* in transit regions from the front regions F to the middle regions M is gradually increased. A distance in the rightward and leftward direction between the bottom surfaces 42*ca* in transit regions from the rear regions R to the middle regions M is gradually increased.

Figure 5:
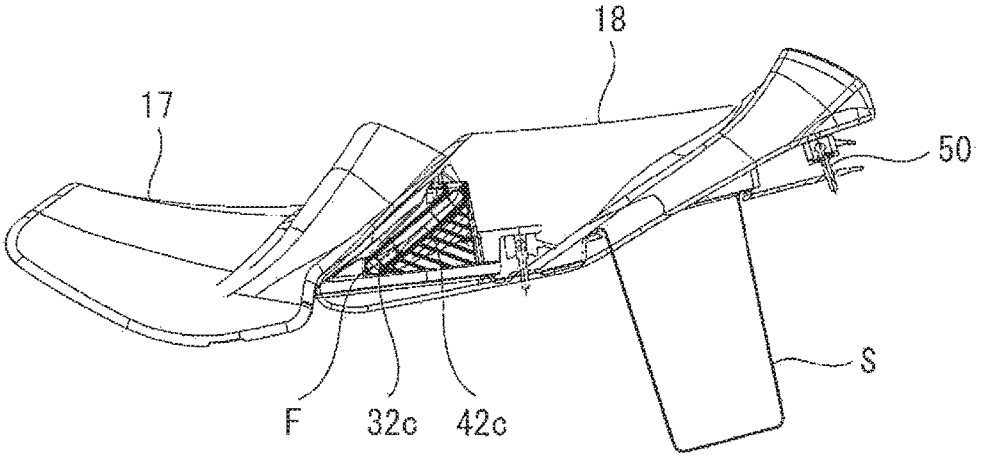
FIG. 5 is a lateral perspective (transparent) view showing the rear seat of FIG. 1 in a closed state (at a closed position), and a region that is in the vicinity of the rear seat.
Figure 6:
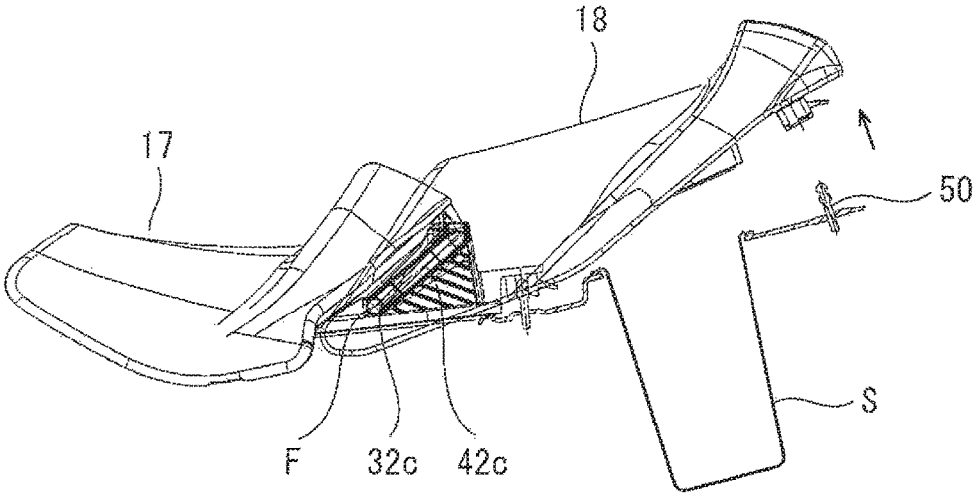
FIG. 6 is a lateral perspective (transparent) view showing the rear seat of FIG. 5 in an unlocked state and a region that is in the vicinity of the rear seat.
Figure 7:
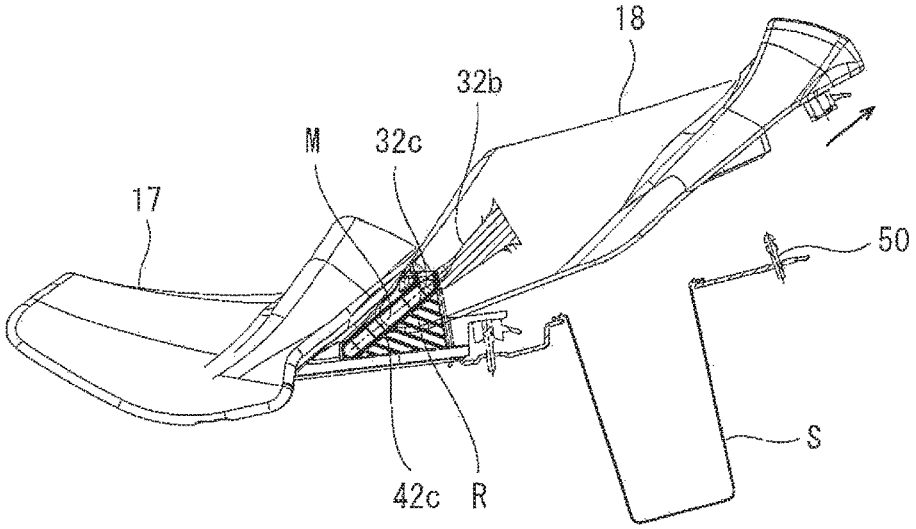
FIG. 7 is a lateral perspective (transparent) view showing the rear seat of FIG. 6 in a sliding state and a region that is in the vicinity of the rear seat.
Figure 8:
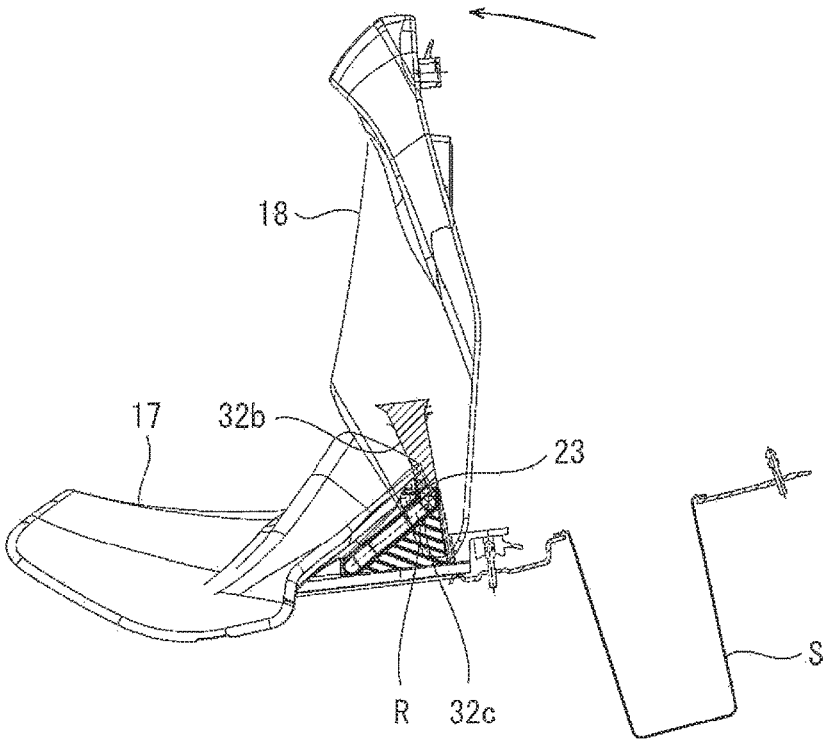
FIG. 8 is a lateral perspective (transparent) view showing the rear seat of FIG. 1 in an open state (at an open position) and a region that is in the vicinity of the rear seat.

FIG. 5 is a lateral perspective (transparent) view showing the rear seat 18 of FIG. 1 in the closed state (at the closed position) and a region that is in the vicinity of the rear seat 18. FIG. 6 is a lateral perspective (transparent) view showing the rear seat 18 of FIG. 5 in an unlocked state and a region that is in the vicinity of the rear seat 18. FIG. 7 is a lateral perspective (transparent) view showing the rear seat 18 of FIG. 6 in a sliding state and a region that is in the vicinity of the rear seat 18. FIG. 8 is a lateral perspective (transparent) view showing the rear seat 18 of FIG. 1 in the open state (at the open position) and a region that is in the vicinity of the rear seat 18. As shown in FIG. 5, the personal watercraft 1 is provided with a lock mechanism 50 which locks the rear portion of the rear seat 18 to the seat support section 4*b*. For example, the lock mechanism 50 is a latch mechanism which is engaged when the user presses down the rear portion of the rear seat 18.

Then, as shown in FIG. 6, the user raises the rear portion of the rear seat 18 so that the rear seat 18 can be rotated around the pins 32*c*. By doing so, the latch mechanism of the lock mechanism 50 is disengaged, so that the rear seat 18 becomes free from the body 2.

Then, as shown in FIG. 7, the user slides the rear seat 18 in the rearward direction. At this time, the pins 32*c* of the rear seat 18 are guided in the rearward direction along the guide grooves 42*c*, respectively. Since the guide grooves 42*c* are inclined in the upward direction from the front to the rear, the user can easily slide the rear seat 18 in a state in which the rear end portion of the rear seat 18 is raised.

As described with reference to FIG. 4, the distance L1 in the rightward and leftward direction between the bottom surfaces 42*ca* of the middle regions M of the pair of right and left guide grooves 42*c* is longer than the distance L2 in the rightward and leftward direction between the bottom surfaces 42*ca* of the front regions F of the pair of right and left guide grooves 42*c*. In this structure, when the rear seat 18 is slid and the pins 32*c* reach the middle regions M, a resistance of the slide operation increases, while when the pins 32*c* reach the rear regions R, the resistance of the slide operation decreases. From the change in the resistance of the slide operation, the user can recognize the operation state. Since the distance L2 in the rightward and leftward direction between the bottom surfaces 42*ca* of the rear regions R is shorter than the distance L1 in the rightward and leftward direction between the bottom surfaces 42*ca* of the middle regions M, the pins 32*c* are easily positioned in the rear regions R of the guide grooves 42*c*, respectively, at a time point when the pins 32*c* reach the rear regions R, respectively.

Then, as shown in FIG. 8, the user rotates the rear seat 18 in the forward direction around the pins 32*c* located in the rear regions R. The rear seat 18 is placed in an upright position (extends substantially vertically). In a state in which the arms 32*b* of the rear seat 18 are inclined in the forward direction, the positioning sections 23 provided at the guide block 42*b* of the front seat 17 contact the arms 32*b*, respectively, from the front, and support the arms 32*b*, respectively. In this state, even if the user takes the hand off the rear seat 18, the rear seat 18 can be kept at the upright position, and can be kept in the open state in which the storage S is exposed. Thus, in a case where the user rotates the rear seat 18 to expose the storage S, the rear seat 18 can be placed at the upright position for itself (without supporting the rear seat 18 by the user's hand), the user can easily access the storage S with both hands.

In accordance with the above-described configuration, in a case where the rear end 17*a* of the front seat 17 is located rearward of and above the front end 18*a* of the rear seat 18 and the front seat 17 is present on the rotation trajectory of the rear seat 18, the front seat 17 can be located apart from the rotation trajectory of the rear seat 18 without detaching the front seat 17, by guiding in the rearward direction the pivot section 21 at the front end portion of the rear seat 18 around which the rear seat 18 is rotated, by the slider section 22, and by sliding the rear seat 18 in the rearward direction. This allows the user to easily access the storage S provided at the underside of the rear seat 18 without detaching the front seat 17.

Numerous improvements and alternative embodiment of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. A personal watercraft comprising:

a body including a seat support section in which a storage is accommodated;

a front seat which is mountable on a front portion of the seat support section and on which a rider is seated in a state in which the rider straddles the front seat;

a rear seat which covers the storage from above in a state in which the rear seat is secured onto a rear portion of the seat support section, and on which a passenger is seated on the rear seat in a state in which the passenger straddles the rear seat; and an opening/closing mechanism including a pivot section which is provided at a front end portion of the rear seat and opens and closes the rear seat around a rotational axis line extending in a rightward and leftward direction, and a slider section which guides the pivot section and slides the rear seat in a rearward direction, the rear seat being configured to be opened to expose the storage, wherein in a closed state in which the front seat and the rear seat are secured onto the seat support section, a rear end of the front seat is located rearward of and above a front end of the rear seat, and the pivot section is located below and forward of the rear end of the front seat.

2. The personal watercraft according to claim 1, wherein the opening/closing mechanism further includes a positioning section which supports the rear seat such that the rear seat is inclined in a forward direction, in an open state in which the rear seat exposes the storage.

3. The personal watercraft according to claim 1, wherein the front seat includes a front cushion member and a front bottom plate provided at an underside of the front cushion member, wherein the rear seat includes a rear cushion member and a rear bottom plate provided at an underside of the rear cushion member, and wherein the opening/closing mechanism is provided at the front bottom plate and the rear bottom plate.

4. The personal watercraft according to claim 3, wherein the front bottom plate includes:

a front bottom plate body mounted on a lower surface of the front cushion member;

a guide block protruding rearward from the front bottom plate body; and a pair of right and left guide grooves provided in side surfaces, respectively, of the guide block, wherein the rear bottom plate includes:

a rear bottom plate body mounted on a lower surface of the rear cushion member;

a pair of right and left arms protruding forward from the rear bottom plate body; and a pair of right and left pins protruding from tip end portions of the pair of right and left arms, respectively such that the pins are closer to each other, and wherein the pivot section includes the pair of right and left pins, and the slider section includes the pair of right and left grooves.

5. The personal watercraft according to claim 4, further comprising:

a lock mechanism which locks a rear portion of the rear seat to the seat support section, wherein the pair of right and left guide grooves are inclined in an upward direction, from a front to a rear.

6. The personal watercraft according to claim 4, wherein each of the pair of right and left guide grooves has a front region in which corresponding one of the pair of right and left pins is located, in a state in which the rear seat is at a closed position, a rear region in which the corresponding one of the pair of right and left pins is located, in a state in which the rear seat is at an open position, and a middle region between the front region and the rear region, and wherein a distance in the rightward and leftward direction between bottom surfaces of middle regions of the pair of right and left guide grooves is longer than a distance in the rightward and leftward direction between bottom surfaces of front regions of the pair of right and left guide grooves, and a distance in the rightward and leftward direction between bottom surfaces of rear regions of the pair of right and left guide grooves.

* * * * *